US006971912B2

(12) United States Patent
Montena et al.

(10) Patent No.: US 6,971,912 B2
(45) Date of Patent: Dec. 6, 2005

(54) METHOD AND ASSEMBLY FOR CONNECTING A COAXIAL CABLE TO A THREADED MALE CONNECTING PORT

(75) Inventors: Noah Montena, Syracuse, NY (US); David Jackson, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 25 days.

(21) Appl. No.: 10/779,927

(22) Filed: Feb. 17, 2004

(65) Prior Publication Data

US 2005/0181668 A1 Aug. 18, 2005

(51) Int. Cl.[7] ..... H01R 9/05
(52) U.S. Cl. ..... 439/578
(58) Field of Search ..... 439/578–585

(56) References Cited

U.S. PATENT DOCUMENTS

| | | | | |
|---|---|---|---|---|
| 3,907,399 | A | 9/1975 | Spinner | 439/583 |
| 4,290,663 | A | 9/1981 | Fowler et al. | 439/610 |
| 4,377,320 | A | 3/1983 | Lathrop et al. | 439/585 |
| 4,662,693 | A | 5/1987 | Hutter et al. | 439/583 |
| 5,002,503 | A | 3/1991 | Campbell et al. | 439/578 |
| 5,217,393 | A | 6/1993 | Del Negro et al. | 439/585 |
| 5,295,864 | A | 3/1994 | Birch et al. | 439/578 |
| 5,470,257 | A | 11/1995 | Szegda | 439/578 |
| 5,501,616 | A | 3/1996 | Holliday | 439/585 |
| 5,525,076 | A | 6/1996 | Down | 439/585 |
| 5,632,651 | A | 5/1997 | Szegda | 439/578 |
| 5,667,405 | A | 9/1997 | Holliday | 439/585 |
| 5,857,865 | A | 1/1999 | Shimirak et al. | 439/277 |
| 5,975,951 | A | 11/1999 | Burris et al. | 439/585 |
| 6,027,373 | A | 2/2000 | Gray et al. | 439/578 |
| 6,102,738 | A | 8/2000 | Macek et al. | 439/584 |
| 6,168,455 | B1 | 1/2001 | Hussaini | 439/394 |
| 6,179,660 | B1 | 1/2001 | Salaguinto et al. | 439/595 |
| 6,210,222 | B1 | 4/2001 | Langham et al. | 439/583 |
| 6,322,390 | B1 | 11/2001 | Takeuchi | 439/578 |
| 2001/0034159 | A1 | 10/2001 | Pitschi | 439/583 |

*Primary Examiner*—Javaid H. Nasri
(74) *Attorney, Agent, or Firm*—Wood, Phillips, Katz, Clark & Mortimer

(57) ABSTRACT

An assembly for connecting a coaxial cable, with a conductive sheath and a surrounding insulating jacket, to a threaded male connecting port. The connecting assembly has a tubular fitting with a central axis and axially spaced first and second ends. The tubular fitting has a rotatable nut assembly at the first end to threadably engage a threaded male connecting port. The tubular fitting further has a cylindrical connecting body for engaging a conductive sheath on a coaxial cable. The tubular fitting further has a sleeve assembly around the connecting body. The sleeve assembly and connecting body cooperatively define a cable-engaging assembly and are configured so that an insulating jacket on a coaxial cable operatively connected to the connecting assembly is captively located between the sleeve assembly and connecting body. The rotatable nut assembly has a first shoulder and the cable-engaging assembly has a second shoulder. The first and second shoulders are selectively engageable to allow at least a part of the rotatable nut assembly to be pivoted around the central axis to bear the first shoulder against the second shoulder and thereby urge at least a part of the cable-engaging assembly in movement around the central axis.

27 Claims, 10 Drawing Sheets

METHOD AND ASSEMBLY FOR CONNECTING A COAXIAL CABLE TO A THREADED MALE CONNECTING PORT

BACKGROUND OF THE INVENTION

1. Field of the Invention

This invention relates to connectors for coaxial cable and, more particularly, to a method and assembly for connecting a coaxial cable to a threaded male connecting port.

2. Background Art

Coaxial cable is used in cable television systems (CATV), subscription television systems (STV), master antenna television systems (MATV), and elsewhere. It is common to connect coaxial cables in these systems using releasable connectors at a splice or drop location. One typical connector has a tubular fitting, with an associated nut, which has threads that are complementary to those on a male connecting port. By tightening the nut, a secure mechanical and electrical connection can be established.

It is common in this industry for these connectors to be left loose on various pieces of equipment. This is typical of connections that are made outdoors, such as on taps and splitters, as well as indoors, as behind a television or other electronic component. A loose outdoor connector can cause undesired broadcasting of signals beyond the cable and/or allow moisture to enter the cable to cause corrosion within the connection and the equipment. Indoors, a loose connection allows electromagnetic interference of all types to pollute the signal within a cable, potentially causing degradation of picture quality, as well as loss of data in the event that the connection is established on a computer feed. As a result of these loose connections, potentially unnecessary maintenance calls may be required. This ultimately contributes to higher operating expenses for an associated system.

To avoid these problems, technicians are generally trained to follow specific steps during the installation process. Installation specifications typically require the use of a torque wrench on the rotatable connector nuts with a pre-set limit sufficient to ensure adequate tightness to avoid the above conditions. However, the use of a wrench, as required to generate the specified torque, may be inconvenient at an installation site. Often, in the interest of saving time, a technician may forego the use of a wrench, even though there is no impediment to, or inconvenience associated with, its use. As a result, connectors may be installed only to finger tightness at the various equipment ports. Typically, an average technician is able to achieve 2–5 inch-pounds of torque with his/her fingers on a conventional 7/16 hex nut with a convenient access. This is well below the recommended specification of 30 inch-pounds. The torque achievable through hand tightening may not even be sufficient to overcome thread roughness, thus potentially leaving a gap between the contacting surfaces of the connecting port and the connector carrying the cable.

The industry continues to look for connector designs that will be installed consistently by technicians and which will produce the desired integrity of connection, even in the absence of the use of tools by an installer.

SUMMARY OF THE INVENTION

In one form, the invention is directed to an assembly for connecting a coaxial cable, with a conductive sheath and a surrounding insulating jacket, to a threaded male connecting port. The connecting assembly has a tubular fitting with a central axis and axially spaced first and second ends. The tubular fitting has a rotatable nut assembly at the first end to threadably engage a threaded male connecting port. The tubular fitting further has a cylindrical connecting body for engaging a conductive sheath on a coaxial cable. The tubular fitting further has a sleeve assembly around the connecting body. The sleeve assembly and connecting body cooperatively define a cable-engaging assembly and are configured so that an insulating jacket on a coaxial cable operatively connected to the connecting assembly is captively located between the sleeve assembly and connecting body. The rotatable nut assembly has a first shoulder and the cable-engaging assembly has a second shoulder. The first and second shoulders are selectively engageable to allow at least a part of the rotatable nut assembly to be pivoted around the central axis to bear the first shoulder against the second shoulder and thereby urge at least a part of the cable-engaging assembly in movement around the central axis.

In one form, the first and second shoulders are spaced in circumferentially opposite directions relative to the central axis.

In one form, the sleeve assembly is joined to the connecting body to define the cable-engaging assembly and the second shoulder is on the sleeve assembly.

In one form, one of the sleeve assembly and connecting body has a projection defining one of the first and second shoulders and the other of the sleeve assembly and connecting body has a receptacle for the projection and defines the other of the first and second shoulders.

In one form, the nut assembly has a rotatable part with threads to engage threads on a threaded male connecting port, and first and second states. With the nut assembly in the first state, the rotatable part can be pivoted through 360° around the central axis without causing the first and second shoulders to engage. With the nut assembly in the second state, pivoting of the rotatable part causes the first shoulder to engage the second shoulder.

The nut assembly may be changeable from the first state into the second state by moving the rotatable part of the nut assembly axially relative to the cable-engaging assembly.

In one form, the entire nut assembly is movable as one piece around the central axis of the tubular fitting.

In one form, there is a third shoulder on the nut assembly and a fourth shoulder on the cable-engaging assembly. The third shoulder engages the fourth shoulder simultaneously as the first shoulder engages the second shoulder. The third and fourth shoulders are selectively engageable to allow the at least part of the rotatable nut assembly to be pivoted around the central axis to bear the third shoulder against the fourth shoulder and thereby urge the at least part of the cable-engaging assembly in movement around the central axis.

In one form, the rotatable part of the nut assembly is slidable guidingly along the cable-engaging assembly.

The rotatable part of the nut assembly may be slidable guidingly along the cylindrical connecting body.

In one form, the cylindrical connecting body has a first stop surface facing axially in a first direction. The sleeve assembly defines a second stop surface facing axially oppositely to the first direction. The rotatable part of the nut assembly has a portion that resides between the first and second stop surfaces. The portion of the rotatable part of the nut assembly is movable a predetermined axial distance between a) a first position wherein the portion of the rotatable part of the nut assembly abuts to the first stop surface and b) a second position wherein the portion of the rotatable part of the nut assembly abuts to the second stop surface. The nut assembly is in the first state with the portion of the rotatable part of the nut assembly in the first position and in the second state with the portion of the rotatable part of the nut assembly in the second position.

In one form, the tubular fitting has a length between the first and second ends. The nut assembly has a rotatable part with threads to engage threads on a threaded male connecting port. The rotatable part of the nut assembly has a radially outwardly facing surface that is engageable by a user to facilitate pivoting movement of the rotatable part around the central axis. The radially outwardly facing surface has a length that extends to at least one half the length of the tubular fitting.

In one form, the radially outwardly facing surface may extend to at least three fourths of the length of the tubular fitting.

In one form, the radially outwardly facing surface has a diameter and a portion that increases progressively in diameter along the central axis.

The radially outwardly facing surface may have a contoured shape to facilitate grasping between two fingers of a user.

In one form, the radial outwardly facing surface has a substantially cylindrical shape with circumferentially spaced grooves formed therethrough.

The radially outwardly facing surface may have a polygonally-shaped portion which is engageable with a turning tool. The polygonally-shaped portion extends over less than one half the length of the radially outwardly facing surface.

In one form, the threads on the rotatable part are dimensioned to accommodate a male connecting port having a first diameter and the radially outwardly facing surface extends to a second diameter that it at least 1.2 times the first diameter.

The second diameter may be at least 1.4 times the first diameter, or at least 1.5 times the first diameter.

In another form, the invention is directed to an assembly for connecting a coaxial cable with a conductive sheath and a surrounding insulating jacket to a threaded male connecting port. The connecting assembly has a tubular fitting with a central axis and axially spaced first and second ends. A nut structure at the first end of the tubular fitting has a rotatable part to threadably engage a threaded male connecting port. The nut structure has a first state and second state. First structure is provided on the tubular fitting to receive a coaxial cable at the second end of the tubular fitting and to electrically and mechanically connect to a coaxial cable directed into the second end of the tubular fitting. The nut structure and first structure cooperate to a) allow the nut structure to pivot through 360° around the central axis without thereby causing any part of the first structure to pivot around the central axis with the nut structure in the first state and b) cause a part of the first structure to follow pivoting movement of the rotatable part of the nut structure around the central axis of the nut structure in the second state.

The invention is further directed to a method of connecting a coaxial cable with a conductive sheath, a surrounding insulating jacket, and a core element to a threaded male connecting port. The method includes the steps of: providing a connecting assembly having a tubular fitting with a central axis and axially spaced first and second ends, with the tubular fitting having a rotatable nut assembly with a rotatable part at the first end of the tubular fitting, a cylindrical connecting body, and a sleeve assembly, with the sleeve assembly and connecting body cooperatively defining a cable-engaging assembly; directing the coaxial cable into the second end of the tubular fitting so that the tubular fitting and coaxial cable are in a first relative axial relationship and so that a part of the tubular fitting resides between the insulating jacket and the core of the coaxial cable; with the coaxial cable and tubular fitting in the first relative axial relationship, moving the coaxial cable and tubular fitting towards each other while turning a part of the tubular fitting around the central axis of the tubular fitting; placing the coaxial cable and tubular fitting in an operative relative axial relationship; electrically connecting the connecting body to the conductive sheath; and threadably engaging the rotatable part of the rotatable nut assembly with the threaded male connecting port.

In one form, the step of turning the part of the tubular fitting involves turning the rotatable part of the nut assembly and thereby causing the rotatable part of the nut assembly to turn the part of the tubular fitting.

The step of turning the part of the tubular fitting may involve turning the connecting body.

In one form, the step of threadably engaging the rotatable part of the rotatable nut assembly comprises turning the rotatable part of the nut assembly with the nut assembly in a first state and further including the step of placing the nut assembly in a second state before turning the part of the tubular fitting.

In one form, the rotatable part of the nut assembly has a radially outwardly facing surface and the step of turning a part of the tubular fitting involves gripping the radially outwardly facing surface between a user's finger and turning the part of the tubular fitting through the radially outwardly facing surface.

In one form, the rotatable part of the nut assembly has a polygonally-shaped outer surface and the step of turning the part of the tubular fitting involves engaging the polygonally-shaped surface with a tool and manipulating the tool.

DETAILED DESCRIPTION OF THE DRAWINGS

Figures 1, 2:
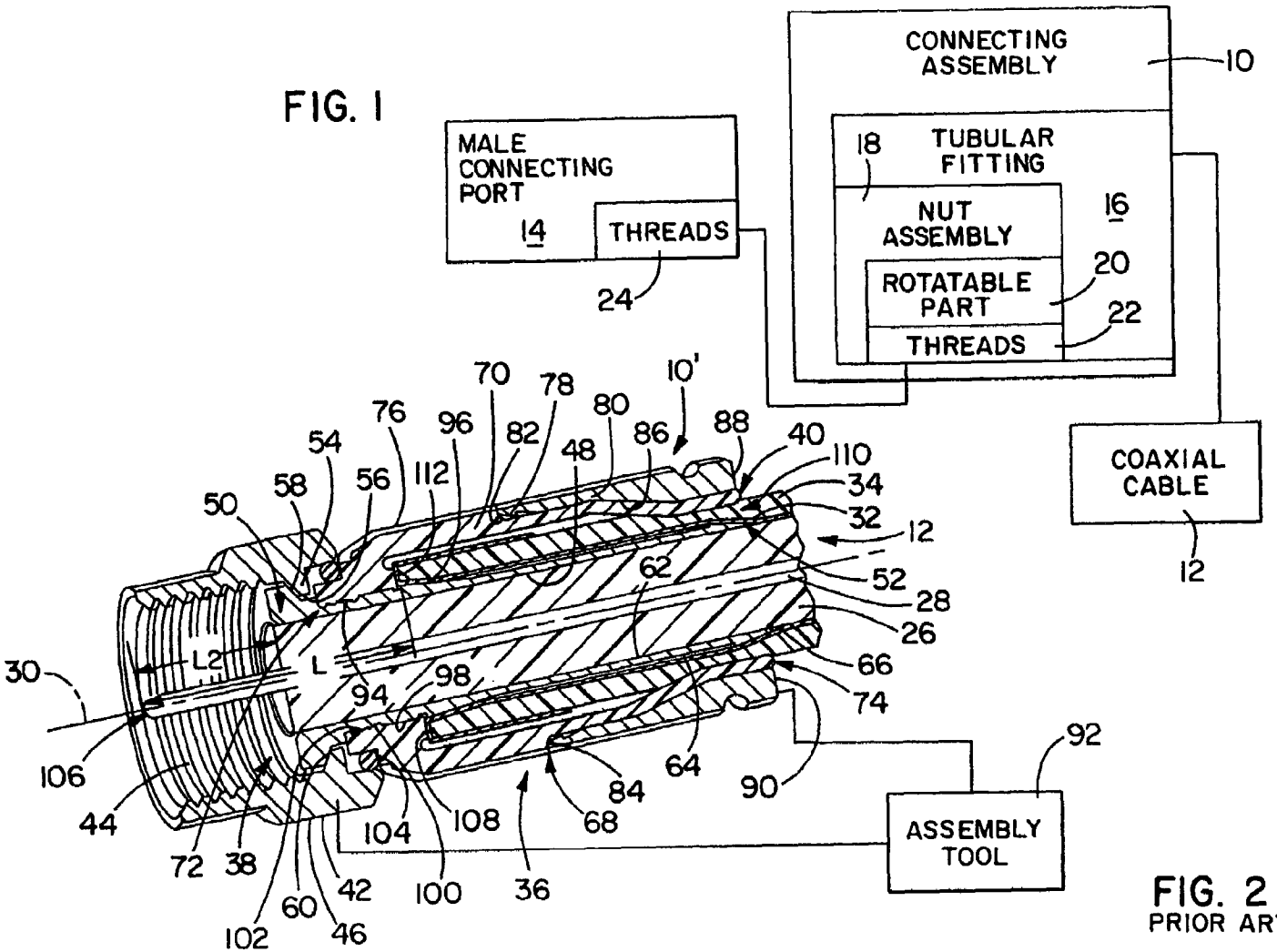
FIG. 2 PRIOR ART
FIG. 1 is a schematic representation of a connecting assembly, according to the present invention, which operatively mechanically and electrically interconnects a coaxial cable with a threaded male connecting port.
FIG. 2 is a cross-sectional, perspective view of a conventional connecting assembly for joining a coaxial cable to a male connecting port and with the connecting assembly connected to a coaxial cable and with a two-part sleeve assembly in one state.

In FIG. 1, a schematic representation of a generic system environment for the present invention is shown. The system consists of an assembly at 10 for connecting a coaxial cable 12 to a male connecting port 14. The male connecting port 14 can be virtually any structure to which coaxial cable is electrically/mechanically connected. As just exemplary structures, the male connecting port 14 may be a splice component, a drop connection port, a part of a component such as a filter, etc. The connecting assembly 10 consists of a tubular fitting 16 which has one open end to accept the coaxial cable 12. The tubular fitting 16 has a nut assembly 18 with a rotatable part 20 having internal threads 22 which engage complementary external threads 24 on the male connecting port 14. The precise configuration of the tubular fitting 16, to allow it to mechanically and electrically connect to the coaxial cable 12, is not critical to the present invention. Similarly, the precise configuration of the nut assembly 18 is not critical to the present invention. The nut assembly 18 may be a single part or may consist of multiple parts, so long as there is a threaded rotatable part 20 that can be turned to mate with the threads 24 on the male connecting port 14.

The present invention is concerned primarily with a structure and method for facilitating the connection of the tubular fitting 16 to the coaxial cable 12 and to the facilitated tightening of the rotatable part 20 to the male connecting port 14. One exemplary, conventional connecting assembly, over which the present invention improves, is shown at 10' in FIGS. 2 and 3. The details of this connecting assembly 10' are shown and described in U.S. Pat. No. 6,153,830, which is incorporated herein by reference. A brief description of that connecting assembly 10' is provided hereinbelow.

The conventional coaxial cable 12 consists of an insulating, cylindrical core 26 surrounding an inner conductor 28 having an axis that is concentric with the central axis 30 of the coaxial cable 12. A metallic sheath 32, in the form of braided wire or a foil, surrounds the insulating core 26 and is in turn surrounded by a dielectric, insulating jacket 34.

The connecting assembly 10' consists of a tubular fitting at 36 having a central axis coincident with the cental axis 30 of the coaxial cable 12 therewithin. The tubular fitting 36 has axially spaced first and second ends 38, 40. A rotatable nut 42 is provided at the first end 38 of the tubular fitting 36. The rotatable nut 42 has internal threads 44 that are complementary to the threads 24 (FIG. 1) on the male connecting port 14. The rotatable nut 42 is rotatable continuously around the central axis 30 to allow tightening of the rotatable nut 42 to the male connecting port 14. The nut 42 has a polygonally-shaped/hexagonal outer surface 46 which can be engaged by a conventional tool/wrench (not shown) by radially directing the tool/wrench captively over the outer surface 46.

The second end 40 of the tubular fitting 36 is adapted to receive and hold the coaxial cable 12. More specifically, the tubular fitting 36 has a cylindrical connecting body 48 with a radially enlarged first end 50 and an axially spaced second end 52. The rotatable nut 42 has a wall 54 with an opening 56 therethrough. The opening 56 is dimensioned to allow the connecting body 48 to be advanced from left to right in FIG. 2 therethrough until an annular shoulder 58, at the first connecting body end 50, abuts to an axially oppositely facing annular surface 60 on the wall 54 of the rotatable nut 42.

The connecting body 48 has a through bore 62 of substantially uniform diameter to snugly receive the insulating core 26 on the coaxial cable 12. The radially outwardly facing surface 64 of the connecting body 48 defines a ramped portion at 66 at the end 52 of the connecting body 48. As the connecting body 48 is moved axially from left to right in FIG. 2 relative to the coaxial cable 12, the ramped portion 66 wedges between the metallic sheath 32 and insulating core 26 so that the metallic sheath 32 and insulating jacket 34 closely surround and embrace the outer surface 64 of the connecting body 48.

The connecting body 48 is surrounded by a two-part sleeve assembly at 68. A first sleeve part 70 is made from a polymer material and has a thickened first axial end 72 and a second axial end 74. The first sleeve part 70 has an outer surface 76 with a radial undercut 78 to receive a second, metal sleeve part 80 so that a nose 82 on the second sleeve part 80 abuts to an axially facing shoulder 84 defined on the first sleeve part 70 by the undercut 78. The second sleeve part 80 has an inside surface 86 which progressively decreases in diameter from the nose 82 toward the axial sleeve part end 88, remote from the nose 82. The second sleeve part 80 has a shoulder 90, which is acted against by an assembly tool 92, which is operable as hereafter described.

Figure 3:
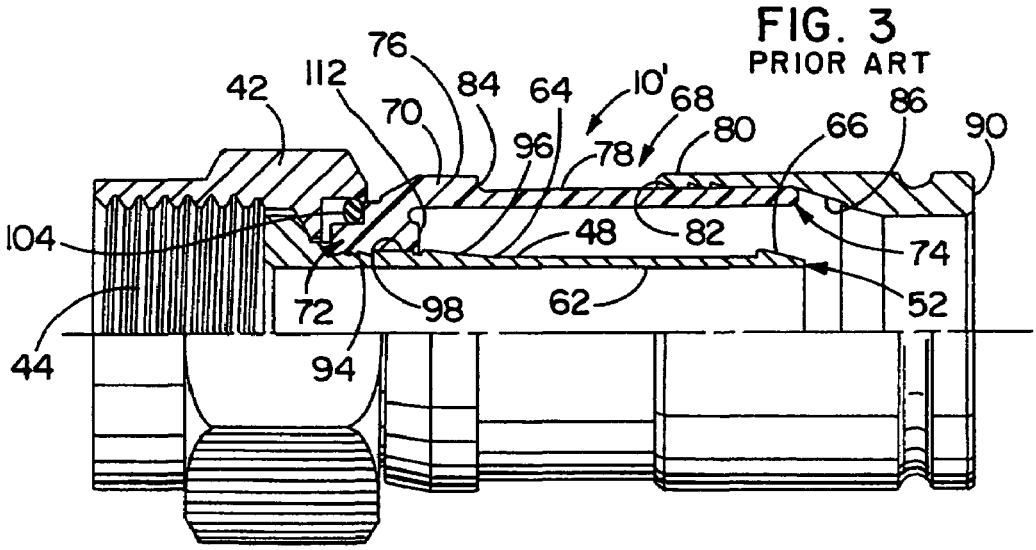
FIG. 3 PRIOR ART
FIG. 3 is a partial cross-sectional view of the connecting assembly in FIG. 2 with the two-part sleeve assembly in a second state preparatory to installation of the coaxial cable.

The tubular fitting 36 is prepared for receipt of the coaxial cable 12 by connecting the first sleeve part 70 to the connecting body 48 with the second sleeve part 80 in a pre-assembly position, as shown in FIG. 3, wherein the second sleeve part 80 is shifted axially, from left to right in FIG. 3, relative to the first sleeve part 70. With the first sleeve part 70 fully separated from the connecting body 48, right to left movement of the first sleeve part 70 causes the inside surface 94 of the thickened end 72 of the first sleeve part 70 to move axially past the ramped portion 66, axially up to a second ramped portion 96 on the outwardly facing surface 64 on the connecting body 48, that increases to a diameter that is greater than the diameter of the inside surface 94 of the sleeve part 70. As a result, the thickened end 72 of the sleeve part 70 must radially deform to allow movement of the sleeve part 70 axially past the second ramped portion 96 to a fully assembled state, as shown in FIGS. 2 and 3. In the fully assembled state, the thickened end 72 nests in a complementary, annular undercut 98 in the connecting body 48 to thereby fix the relative axial relationship between the connecting body 48 and sleeve part 70. Cooperating, annular serrations 100, 102, respectively on the connecting body 48 and sleeve part 70, enhance this connection.

A resilient O-ring 104 seals between the sleeve part 70 and the rotatable nut 42.

The coaxial cable 12 is joined to the tubular fitting 36 by first preparing the cable 12 in a conventional manner. More specifically, a length L of the insulating jacket 34 is severed at the free end 106 of the coaxial cable 12 so as to expose the metallic sheath 32. At the same time, a length L2 of the insulating core 26 and metallic sheath 32 are removed so as to expose a corresponding length of the inner conductor 28. The exposed metallic sheath 32 is doubled back over the newly formed free end 108 of the insulating jacket 34. The exposed, inner conductor 28 and insulting core 26 are then directed into the connecting body bore 62. Upon the end 52 of the connecting body 48 encountering the free end 108 of the insulating jacket 34, the connecting body end 52 wedges between the metallic sheath 32 and insulating core 26. As the coaxial cable 12 continues to be advanced from right to left in FIG. 2, the insulating jacket 34, with the doubled back metallic sheath 32, moves through an opening at 110 between the sleeve part 70 and the connecting body 48. The coaxial cable 12 can be advanced from right to left until the free end 108 of the insulating jacket 34, with the metallic sheath 32 wrapped thereover, abuts to an axially facing, annular shoulder 112 on the sleeve part 70.

The sleeve part 80 is then shifted from the pre-assembly position of FIG. 3 axially into the assembled position of FIG. 2, through the use of the assembly tool 92, which acts upon the sleeve part 80 at the shoulder 90, and on the rotatable nut 42, to draw the sleeve part 80 axially towards the nut 42. In so doing, the sleeve part 70 is progressively deformed by the sleeve surface 86 radially inwardly from a starting state into a holding state, as shown in FIG. 2, wherein the insulating jacket 34 is compressibly captured between the sleeve part 70 and the connecting body 48.

While this connecting assembly 10' has been highly commercially successful, it has some drawbacks inherent to other conventional designs. It may be difficult, particularly in a cold environment wherein the non-metallic coaxial cable components become stiffened, to wedge the connecting body 48 between the insulating core 26 and the insulating jacket 34 and sheath 32 on the coaxial cable 12 and the insulating jacket 34 within the sleeve part 70. This problem also exists with stiff-jacketed cables 12 designed for burial applications. This assembly step is carried out by axially moving the connecting assembly 10' and coaxial cable 12 in a straight line axially towards and against each other a substantial distance, as can be seen in FIG. 2. It is common practice for an installer to exert an axial assembly force on the connecting assembly 10' and cable 12 only until substantial resistance is encountered between the connecting assembly 10' and cable 12, which may occur before a fully assembled relationship is realized. As noted above, this ultimately may lead to a compromised connection, which could affect signal quality, and/or allow inadvertent separation of the connecting assembly 10' and cable 12 to occur.

A further problem, as noted in the Background portion herein, is that the rotatable nut 42 has a relatively short axial extent. The rotatable nut 42, having the polygonally-shaped outer surface 46, is designed to be engaged by a wrench. However, commonly technicians will either not have a wrench available to effect tightening, or will not make the effort to use an available wrench. Instead, the rotatable nut 42 is tightened by grasping the same, as between the thumb and index finger, and tightening the rotatable nut 42 only to a point that is comfortable for the technician. Given the small available grasping surface area, a torque that is substantially less than that specified is typically applied, with the potential ramifications, as previously mentioned.

Referring now to FIGS. 4–8, one exemplary form of the inventive connecting assembly 10 is shown. The connecting assembly 10, as described with respect to FIG. 1, includes the tubular fitting at 16 which has a central axis 114. The tubular fitting 16 has first and second axially spaced ends, 116, 118, respectively. The nut assembly 18 is provided at the first end of the tubular fitting 16. In this embodiment, the nut assembly 18 has a single, pivotable/rotatable part 20 that is movable around the axis 114. The internal threads 22 are provided on the rotatable nut assembly part 20 to engage the threads 24 on the male connecting port 14, as described with respect to FIG. 1, above. As noted previously, the nut assembly 18 could be made to include multiple parts, one of which has the threads complementary to the threads 24 on the male connecting port 14, and which is pivotable to operatively connect the nut assembly 18 to the male connecting port 14.

The tubular fitting 16 incorporates the cylindrical connecting body 48, as previously described. Other configurations for the cylindrical connecting body are contemplated. The tubular fitting 16 further includes a sleeve assembly 120, corresponding to the sleeve assembly 68 in FIGS. 2 and 3, and including a first sleeve part 122 and a second sleeve part 124, having a similar construction, and corresponding in function, to the sleeve parts 70, 80, described for the connecting assembly 10' in FIGS. 2 and 3. A simple crimp-type sleeve assembly (not shown), as well as other designs, are contemplated. The sleeve part 122 differs from the corresponding sleeve part 70 primarily in two respects. First, the sleeve part 122 has an annular undercut 126 between the first and second axially spaced ends 130, 132 thereof, to accommodate the axially extended configuration of the rotatable nut assembly part 20, as described hereinbelow. Secondly, the end 130 of the sleeve part 122 has a modified configuration to cooperate with the rotatable nut assembly part 20 in a novel manner, as hereinafter described.

The sleeve assembly 120 and connecting body 48 connect with each other to cooperatively define a cable-engaging assembly at 134 in substantially the same manner as the connecting body 48 and sleeve assembly 68 are joined on the connecting assembly 10', shown in FIGS. 2 and 3. Similarly, the coaxial cable 12 is operatively engaged with the cable-engaging assembly 134 in the same manner as described with respect to the connecting body 48 and sleeve assembly 68 on the connecting assembly 10' in FIGS. 2 and 3. Thus, a detailed description of the connection of the connecting body 48 and sleeve assembly 120 to each other and the nut assembly 18 and coaxial cable 12 is unnecessary and is not made herein.

With the connecting body 48 and sleeve assembly 120 operatively connected, a radially inwardly projecting portion 136 on the rotatable nut assembly part 20 projects radially into a receptacle 138 between axially oppositely facing stop surfaces 140, 142, respectively, on the connecting body 48 and the sleeve part 122. The stop surface 140 is at a angle $\alpha$ to a plane orthogonal to the axis 114. The portion 136 of the rotatable nut assembly part 20 has a surface 144 with an angle complementary to the angle $\alpha$ to allow facial abutment between the stop surface 140 and surface 144, with the rotatable nut assembly part 20 in a first axial position therefor, as show in FIG. 5, wherein the nut assembly 18 is in a first state. The rotatable nut assembly part 20 is shiftable axially towards the right in FIG. 5 from the first position into a second position therefor, shown in FIG. 6, wherein a surface 146 on the portion 136 of the rotatable nut assembly part 20, projecting into the receptacle 138, facially abuts to the stop surface 142 at the axial end 130 of the sleeve part 122. With the rotatable nut assembly part 20 in its second position, as shown in FIG. 6, the nut assembly 18 is in a second state.

According to the invention, the rotatable nut assembly part 20 is selectively keyed to the cable-engaging assembly 134, and more particularly the sleeve part 122 defining a part thereof, so that pivoting movement of the rotatable nut assembly part 20 around the axis 114 can be imparted to the cable-engaging assembly 134.

More specifically, the axial end 130 of the sleeve part 122 is configured to define circumferentially spaced, arcuately extending, receptacles 148, 150, 152, separated by walls 154, 156, 158. The rotatable nut assembly part 20 has at least one projection 160, extending axially from left to right from the surface 146, to extend into one of the receptacles 148, 150, 152, depending upon the relative angular orientation of the rotatable nut assembly part 20 and sleeve part 122, with the nut assembly 18 in the second state, as shown in FIG. 6. In this embodiment, six projections 160, 160', 160", 160''', 160'''' and 160''''' are provided on the rotatable nut assembly part 20 and are equidistantly spaced around the axis 114. The projections 160–160''''' and walls 154, 156, 158 cooperate to cause a pivoting force to be imparted to the cable-engaging assembly 134 through a pivoting force applied to the rotatable nut assembly part 20, with the rotatable nut assembly part 20 in its second position and the nut assembly in its second state, as shown in FIG. 6.

Figure 8:
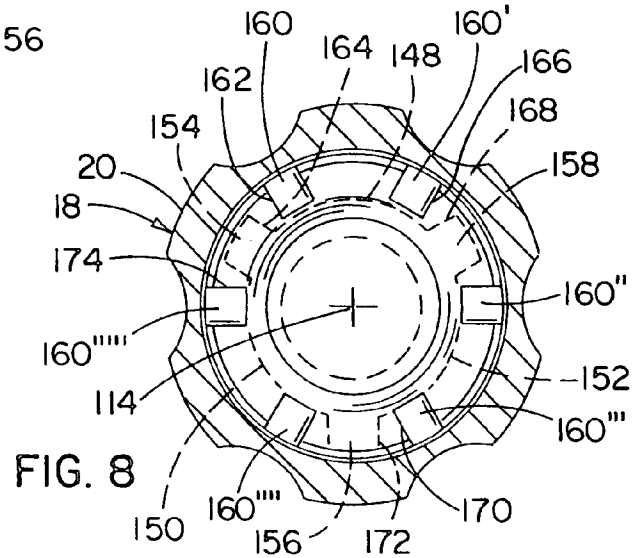
FIG. 8 is a cross-sectional view of structure on the nut assembly which cooperates with the part of the connecting assembly that is pivotable therethrough and taken along line 8—8 of FIG. 4.

More specifically, as shown in FIG. 8, with the projection 160 in the receptacle 148, pivoting movement of the rotatable nut assembly 20 in a counterclockwise direction around the axis 114 causes a circumferentially facing shoulder 162 on the projection 160 to bear against a circumferentially oppositely facing shoulder 164 on the wall 154 to thereby drive the sleeve part 122 in a counterclockwise direction around the axis 114. Clockwise pivoting of the rotatable nut assembly part 20 around the axis 114 bears a circumferentially facing shoulder 166 on the projection 160' against a circumferentially oppositely facing shoulder 168 on the wall 158. While, as mentioned above, only a single projection and receptacle are required to make the inventive structure operational, in a preferred form, simultaneous interaction between the projections 160–160''''' and walls 154, 156, 158 is preferred for a more positive driving of the sleeve part 122 through the rotatable nut assembly part 20.

In this embodiment, two projections 160–160''''' are at all times provided in each of the receptacles 148, 150, 152. The projections 160–160''''' and receptacles 148, 150, 152 are circumferentially dimensioned and spaced so that pivoting movement of the rotatable nut assembly part 20, in either direction around the axis 114, causes simultaneous interaction of three of the projections 160–160''''' with the walls 154, 156, 158. That is, with the rotatable nut assembly part 20 pivoted in a clockwise direction in FIG. 8, the shoulder 166 on the projection 160' bears against the shoulder 168 on the wall 158 simultaneously as a shoulder 170 on the projection 160''' bears on a circumferentially facing shoulder 172 on the wall 156 and simultaneously as a shoulder 174 on the projection 160''''' bears on a circumferentially facing shoulder 176 on the wall 154. A reverse pivoting of the rotatable nut assembly part 20 produces a corresponding interaction of projections 160–160''''' and walls 154, 156, 158 through cooperating shoulders.

With this arrangement, an installer can shift the rotatable nut assembly part 20 from its first position towards its second position and tactilely sense when the projections 160–160''''' are aligned with the receptacles 148, 150, 152. The installer can effect a slight twisting of the nut assembly port 20 in the event that the projections 160–160''''' and receptacles 148, 150, 152 are not circumferentially aligned. Once this alignment is achieved, the rotatable nut assembly part 20 will shift freely axially into its second position.

By reason of having the multiple projections 160–160''''' and receptacles 148, 150, 152, only a modicum of adjusting pivoting is required to align the projections 160–160''''' with the receptacles 148, 150, 152. Additionally, aside from facilitating placement of the rotatable nut assembly part 20 in its second position, the multiple projection/receptacle arrangement distributes the pivoting forces to and through multiple components for a positive transmission of torque to the sleeve part 122 through the rotatable nut assembly part 120.

With this arrangement, the installer can place the connecting assembly 10 in a first relative axial relationship with the coaxial cable 12, wherein the axial end 52 of the connecting body is aligned to be pressed between a) the insulating core 26 and b) the metallic sheath 32 and insulating jacket 34 with the axial end 132 of the sleeve part 122 aligned to be slid over the outside surface of the insulating jacket 34. As the connecting assembly 10 and coaxial cable 12 are moved from the preliminary axial relationship axially towards and against each other, a substantial amount of friction is generated between the components, including a) between the sleeve part 122 and insulating jacket 34 and b) the connecting body 48 and metallic sheath 32. With the rotatable nut assembly part 20 in its second position, the rotatable nut assembly part 20 can be pivoted back and forth, or continuously in one direction around the axis 114, as the connecting assembly 10 and coaxial cable 12 are urged against each other towards the fully assembled state, as shown correspondingly for the prior art connecting assembly 10' in FIG. 2. By pivoting part or all of the cable-engaging assembly 134 through the rotatable nut assembly part 20, locking of the connecting assembly 10 and coaxial cable 12 to each other through frictional resistance can be avoided until the fully assembled state is realized. While the rotatable nut assembly part 20 is in this embodiment keyed to the sleeve part 122, it can be similarly keyed, independently or at the same time, to the cylindrical connecting body 48 to allow a pivoting force to be imparted thereto through the rotatable nut assembly part 120.

Figure 4:
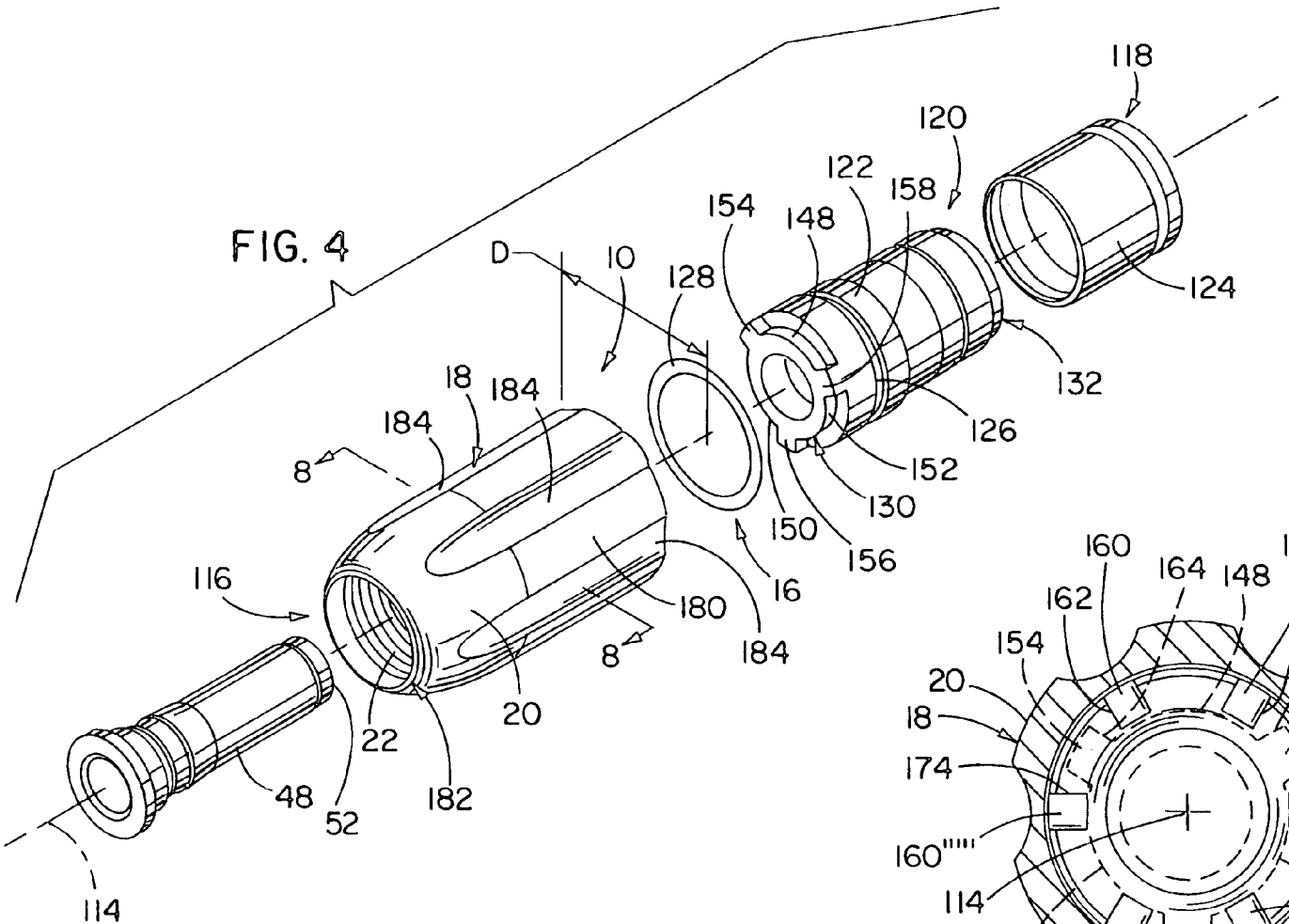
FIG. 4 is an exploded, perspective view of one form of connecting assembly, according to the present invention.
Figure 5:
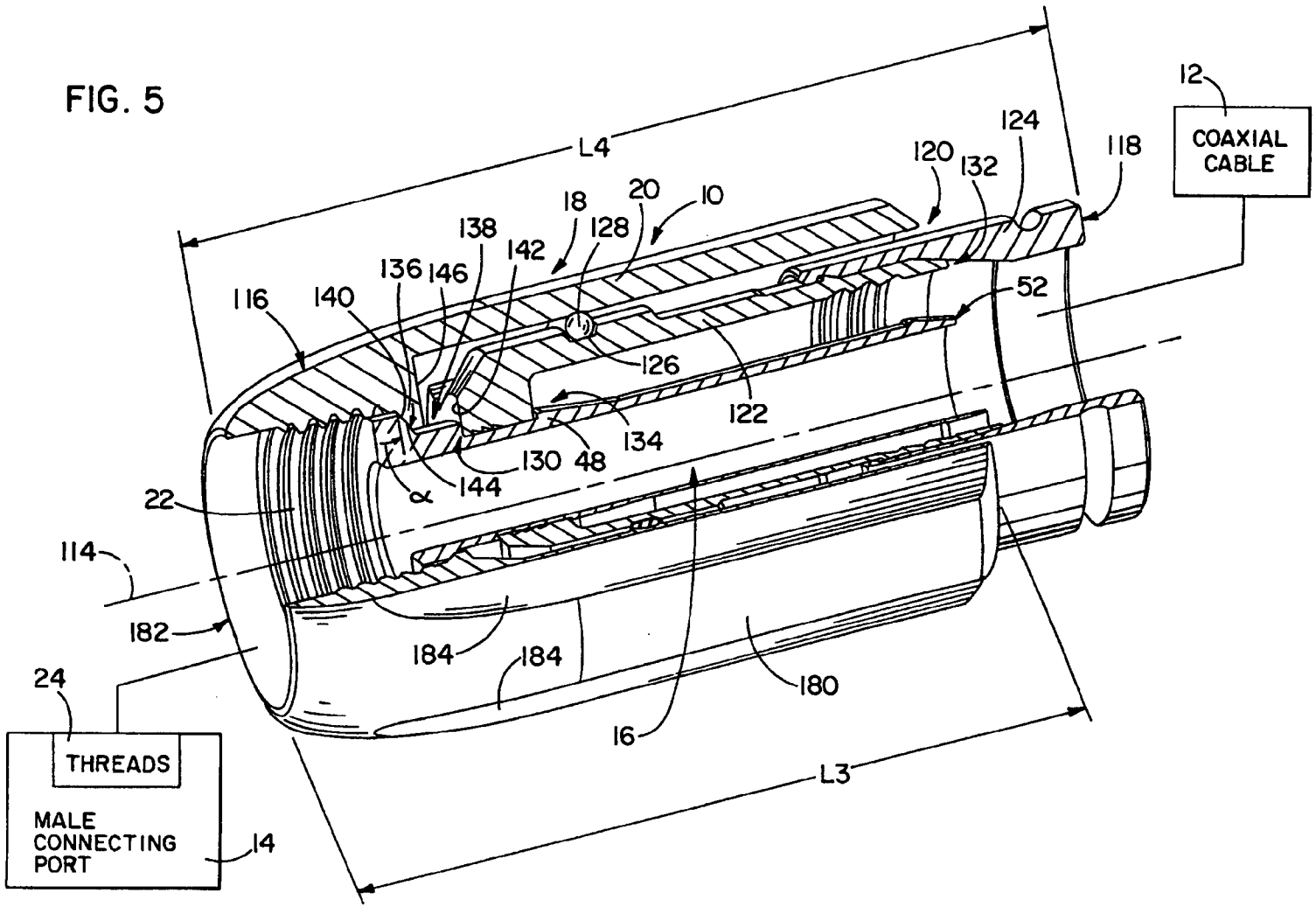
FIG. 5 is an enlarged, cross-sectional view of the connecting assembly in FIG. 4 with a nut assembly thereon in a first state which allows a part of the nut assembly to rotate freely around the central axis of the connecting assembly.
Figure 6:
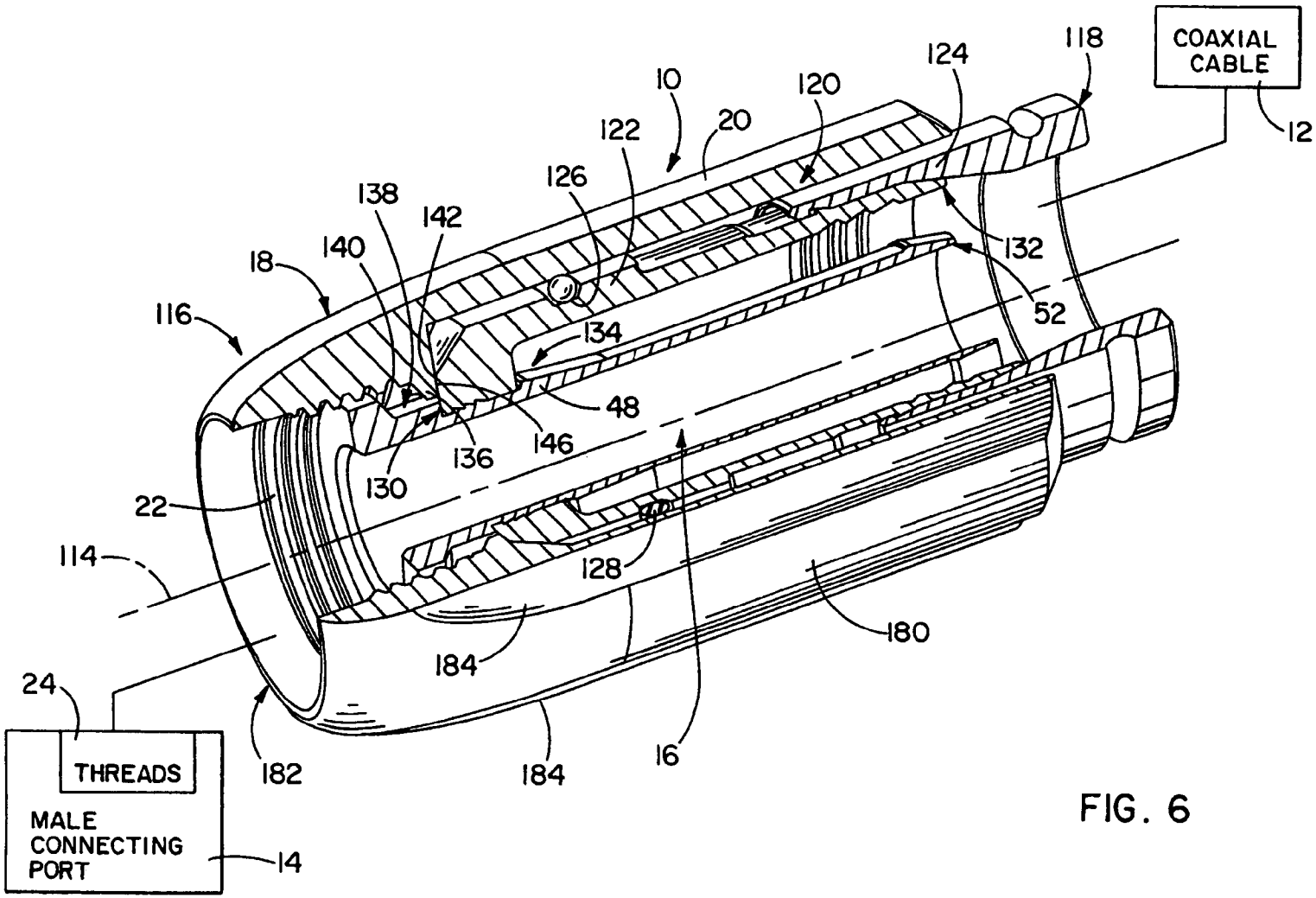
FIG. 6 is a view as in FIG. 5 with the nut assembly in a second state wherein the nut assembly is keyed to a part of the connecting assembly to allow that part of the connecting assembly to be pivoted through the nut assembly.
Figure 7:
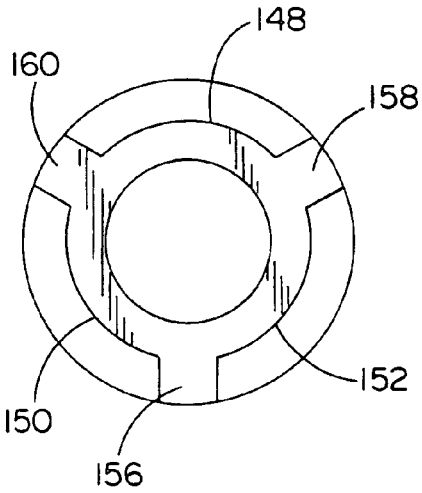
FIG. 7 is an end elevation view of the part on the connecting assembly that is pivoted by the nut assembly in FIGS. 4–6.
Figure 10:
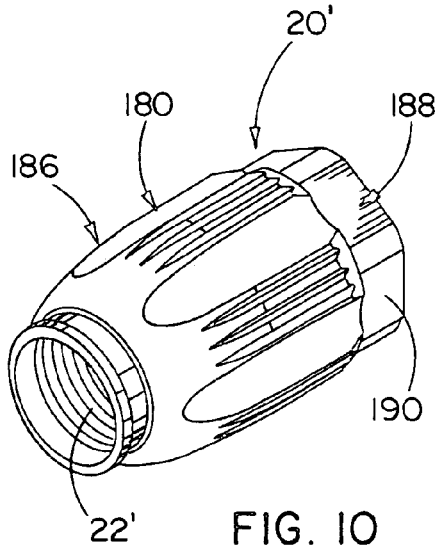
FIG. 10 is a perspective view of a modified form of nut assembly, according to the present invention.
Figure 11:
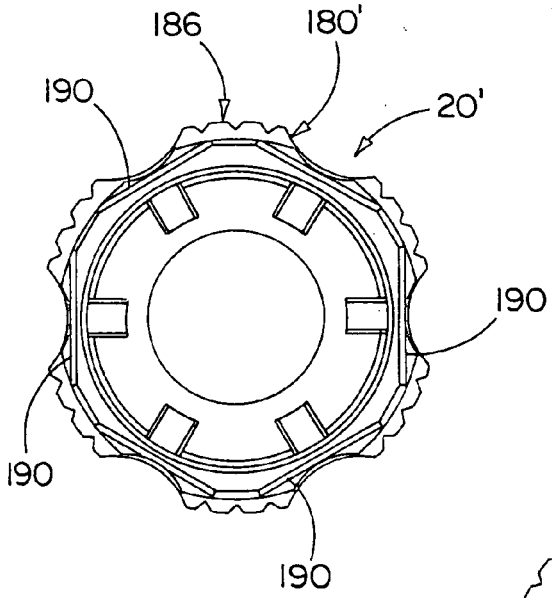
FIG. 11 is an enlarged, end elevation view of the nut assembly in FIG. 10.
Figure 12:
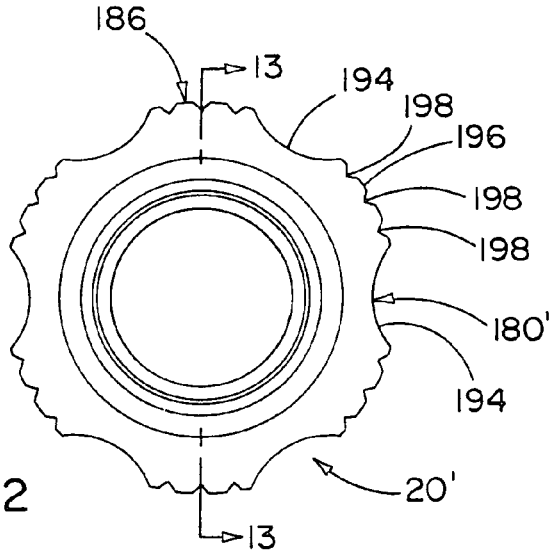
FIG. 12 is an enlarged, elevation view of the nut assembly from the end opposite that in FIG. 11.
Figure 13:
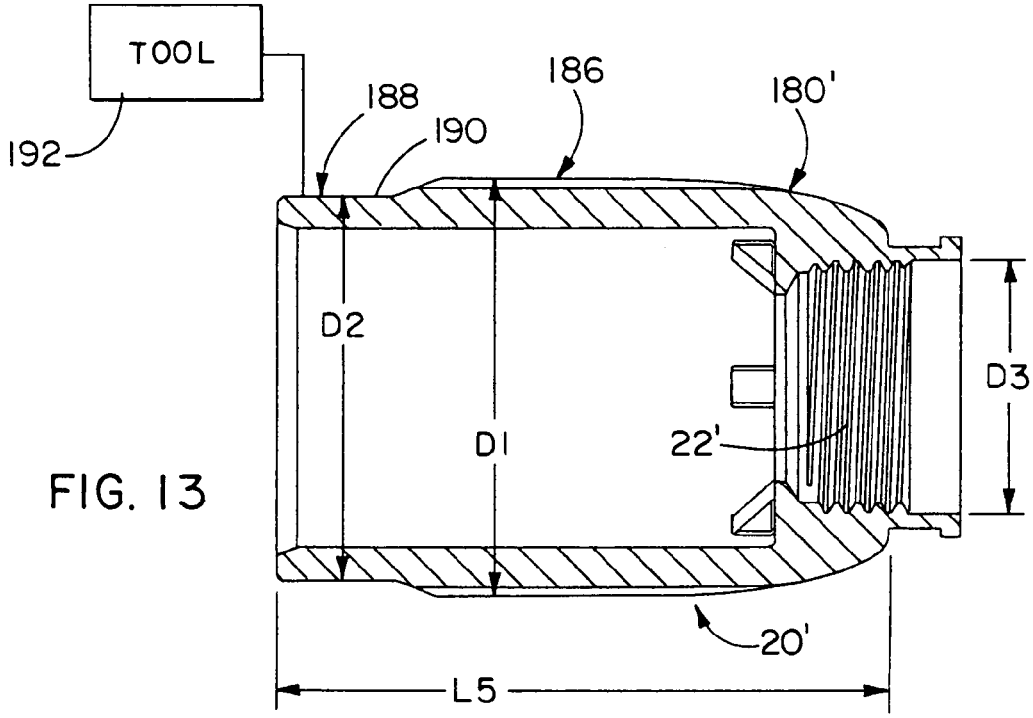
FIG. 13 is an enlarged, cross-sectional view of the nut assembly taken along line 13—13 in FIG. 12.

Once the fully assembled state for the connecting assembly 10 and coaxial cable 12 is realized, the rotatable nut assembly part 20 can be shifted from right to left in FIGS. 4–6 to its first position, which places the nut assembly 18 in the first state. With the rotatable nut assembly part 20 in its first position, the rotatable nut assembly part 20 is rotatable continuously around the axis 114 without any interference between the projections 160–160''''' and sleeve part 122. This allows the nut assembly part 20 to be secured in conventional manner to the threads 24 on the male connecting port 14.

Figure 9:
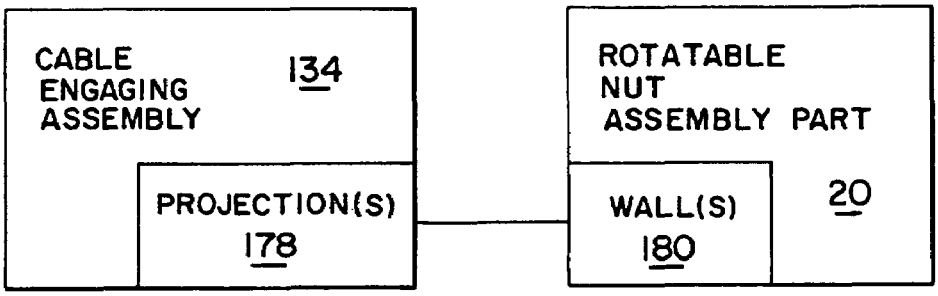
FIG. 9 is a schematic representation of cooperating structure, according to the invention, which allows a part of the connecting assembly to be pivoted through the nut assembly.

It should be understood that the arrangement of the projections 160–160''''' and walls 154, 156, 158 could be changed from that shown. For example, there could be a combination of walls and projections on each of the cable-engaging assembly 134 and rotatable nut assembly part 20. Alternatively, all of the projections, as shown schematically at 178 in FIG. 9, could be on the cable-engaging assembly 134, with the cooperating walls 180 provided on the rotatable nut assembly part 20.

To facilitate turning of the sleeve part 122 through the rotatable nut assembly part 20, and further to facilitate tightening of the nut assembly part 20 to the male connecting port 14 with a desired magnitude of torque, the rotatable nut assembly part 20 is made in this embodiment with an extended axial extent. In the embodiment shown in FIGS. 4–6, the rotatable nut assembly part 20 has an axial length L3 (FIG. 5) that extends to at least one half the overall length L4 of the tubular fitting 16. In this embodiment, the length L3 is at least three fourths of the length L4 and may go up to, or even exceed, the length L4.

With this configuration, the rotatable nut assembly part 20 has an extended, radially outwardly facing surface 180 which can be positively gripped, turned, and axially pulled, to facilitate repositioning of the rotatable nut assembly part 20 and pivoting and axial shifting of the sleeve part 122, as well as tightening of the rotatable nut assembly part 20 to the male connecting port 14. For comfort, in one embodiment, the diameter D (FIG. 4) of the radially outwardly facing surface 180 of the rotatable nut assembly part 20 increases progressively from one axial end 182 thereof towards a mid portion. To further facilitate gripping between a user's fingers, the radially outwardly facing 180 is contoured, and in this case by providing circumferentially spaced grooves 184, which extend lengthwise of the rotatable nut assembly part 20.

A modified form of rotatable nut assembly part, according to the present invention, is shown at 20' in FIGS. 10–13. The rotatable nut assembly part 20' is functionally the same as the rotatable nut assembly part 20, but has a different configuration for the radially outwardly facing surface 180' thereon, through which the rotatable nut assembly part 20' is pivoted about its central axis. The surface 180' is defined by a hand graspable portion at 186 and a tool engageable portion at 188. The tool engageable portion 188 is polygonally shaped and extends over less than one-half the axial length L5 of the rotatable nut assembly part 20'. The tool engageable portion 188 has a series of flats 190 arranged in an hexagonal configuration to accommodate a conventional wrench used by installers. The tool engageable portion 188 may have the same configuration as the outer surface of a standard 7⁄16 inch nut, as used in the cable industry.

The hand graspable portion 186 has a diameter D1 that increases along a portion of the axial length thereof to a maximum dimension adjacent to the tool engaging portion 188. The diameter D1 is also desirably larger than the conventional diameter D2 shown for the tool engaging portion 188, which is configured to accommodate a conventional hex tool 192. In one form, the diameter D1 is selected so that the diameter D1 is at least 1.2 times the diameter D3 of the threads 22'. D1 may be up to 1.4 times D3, 1.5 times D3, or greater.

Grasping of the surface 180' is facilitated by providing axially extending grooves 194, with peaks 196 between adjacent grooves 194. The peaks 196 in and turn have narrower grooves 198 which cooperatively produce a roughened texture for more positive gripping at the peaks 196. There is synergistic gripping capability realized from the combination of the two configurations of grooves 194, 198.

Figure 14:
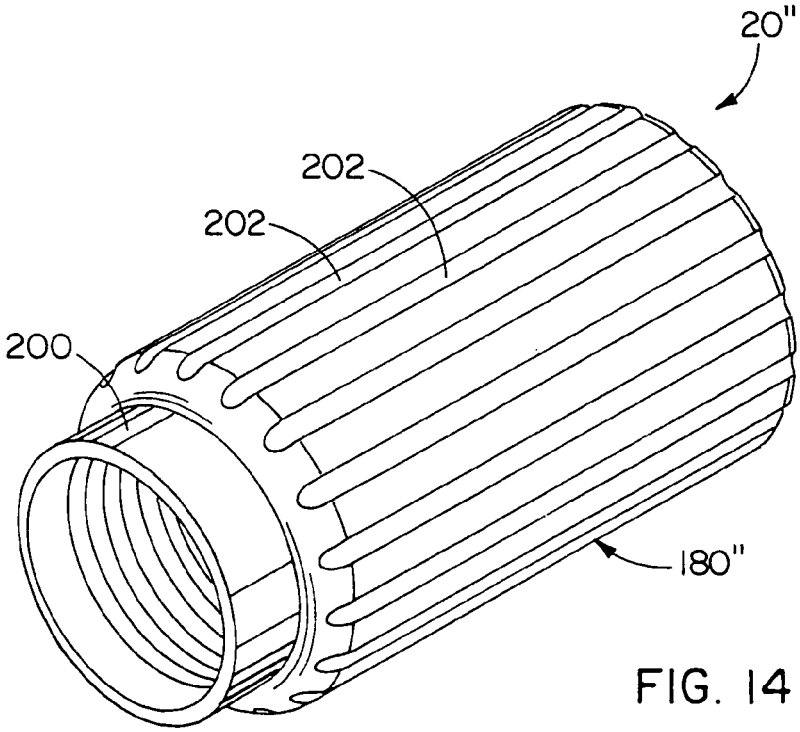
FIG. 14 is a perspective view of a further modified form of nut assembly, according to the present invention, and having a surface that is engageable between the fingers of a user to facilitate rotation thereof.

In FIG. 14, a further modified form of rotatable nut assembly part, according to the present invention, is shown at 20". The rotatable nut assembly part 20" has a radially outwardly facing surface 180" that is substantially uniform in diameter over most of the axial extent thereof. The surface 180" has a reduced diameter portion 200, at one end thereof, to avoid interference with any tool that may be used on a cooperating component to which the rotatable nut assembly part 20" is secured. Circumferentially spaced, longitudinally extending, grooves 202 are provided to enhance the ability of the user to grasp the surface 180".

Figure 15:
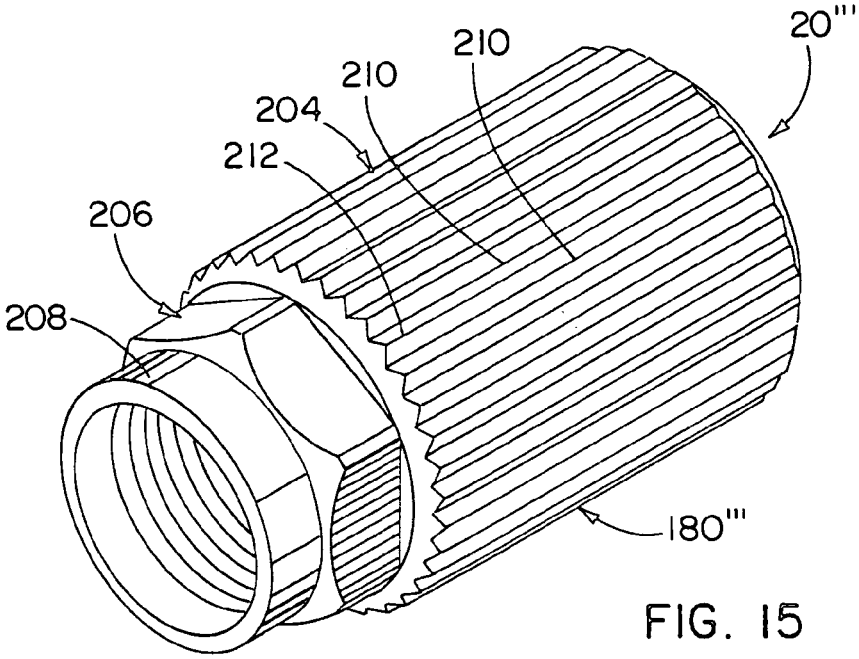
FIG. 15 is a view as in FIG. 14 of a further modified form of nut assembly, according to the present invention, and including tool-engaging and hand-graspable portions.

In FIG. 15, a further modified form of rotatable nut assembly part, according to the present invention, is shown at 20'". The rotatable nut assembly part 20'" has a radially outwardly extending surface 180'" with a hand graspable portion 204, a tool engageable portion 206, and a reduced diameter clearance portion 208. The tool engageable portion 206 corresponds to the tool engageable portion 188, on the rotatable nut assembly part 20', shown in FIGS. 10–13.

The hand graspable portion 204 has circumferentially spaced, V-shaped grooves 210, with sharpened peaks 212 between adjacent grooves 210. The sharpened peaks 212 can be positively grasped between, and turned by, the fingers of a user. The hand graspable portion 204 is shown to have a substantially uniform diameter over its axial extent.

Figure 16:
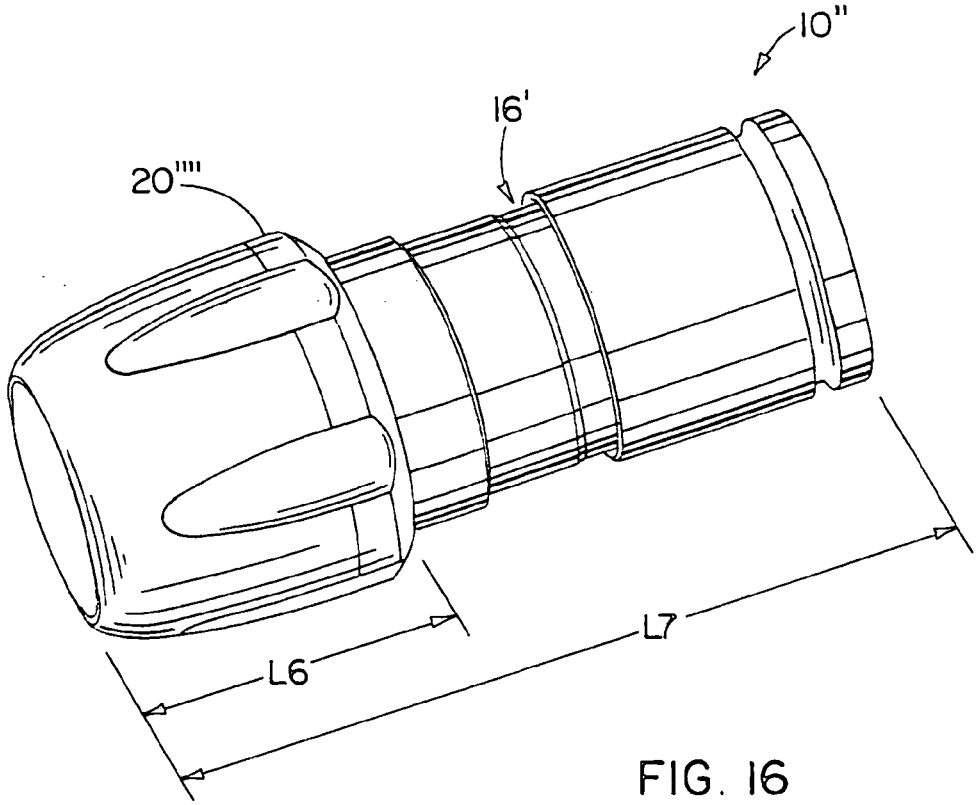
FIG. 16 is a perspective view of a modified form of connecting assembly, according to the present invention.
Figure 17:
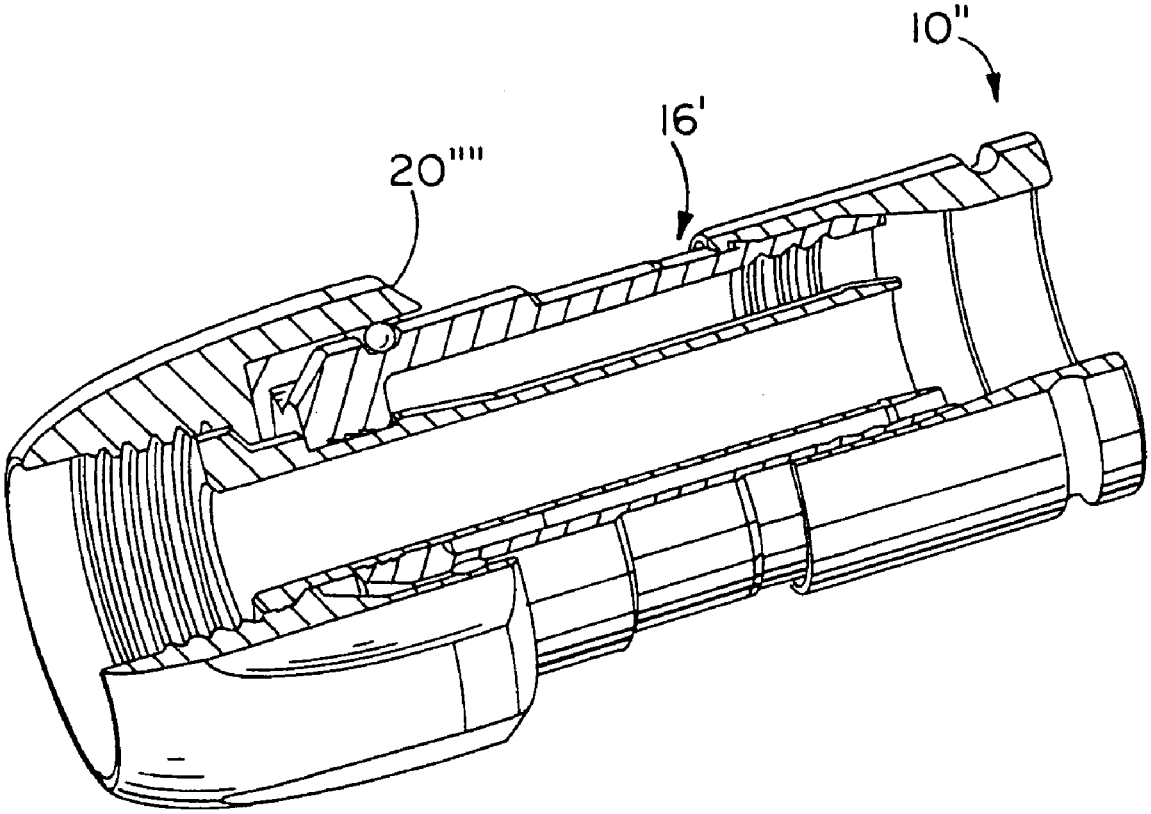
FIG. 17 is a cross-sectional, perspective view of the connecting assembly of FIG. 16.

Other modifications of the inventive structure are contemplated. A further modified form of connecting assembly, according to the present invention, is shown at 10" in FIGS. 16 and 17. The connecting assembly 10" is similar to the connecting assembly 10, shown in FIGS. 4–6, with the primary difference residing in the configuration of the rotatable nut assembly part 20" ". The rotatable nut assembly part 20" " has a configuration similar to the nut assembly part 20, but a considerably lesser axial length L6. In the embodiment shown, the length L6 is less than one-half the overall length L7 of the tubular fitting 16', which corresponds in structure and function to the end fitting 16 in all other material respects.

Figure 18:
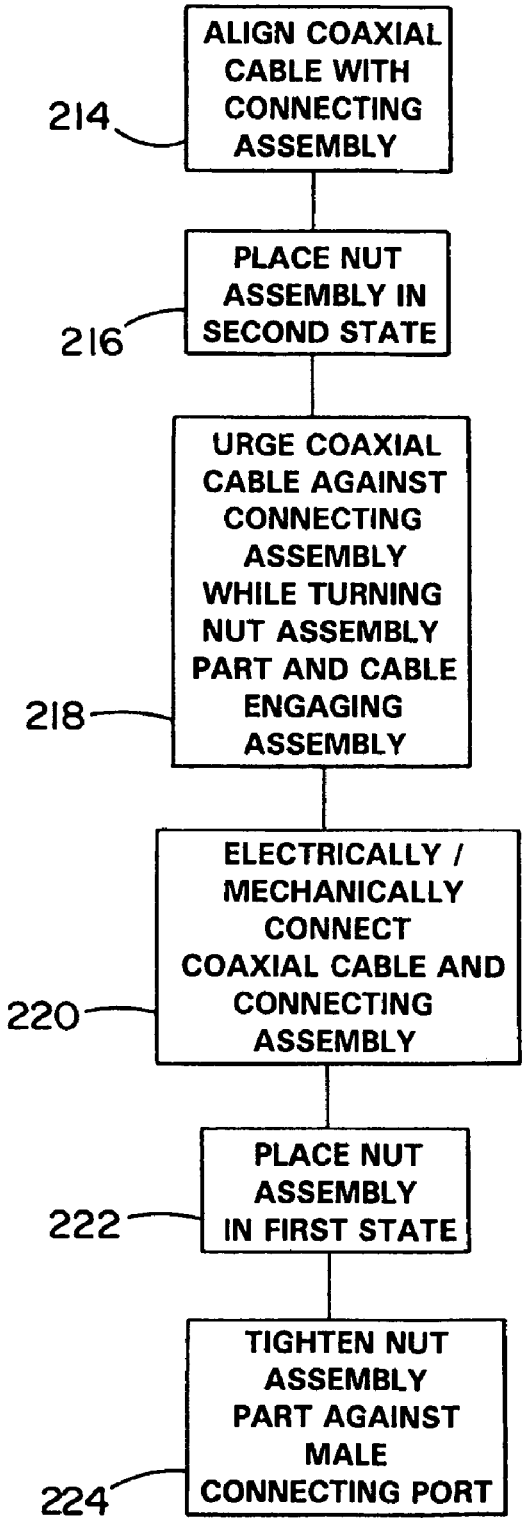
FIG. 18 is a flow diagram representation of a method of connecting a coaxial cable to a threaded male connecting port, according to the present invention.

With each of the above-described embodiments, the connection of the coaxial cable 12 to the connecting assemblies 10, 10" can be accomplished in the same manner, as shown in flow diagram form in FIG. 18, for the exemplary connecting assembly 10. As shown at block 214, the coaxial cable 12 is aligned with the connecting assembly 10 with the coaxial cable 12 and connecting assembly 10 in a first relative axial relationship. As shown at block 216, the nut assembly 18 is placed in the second state therefor. As shown in block 218, the coaxial cable 12 and connecting assembly 10 are urged axially against each other by pulling axially on the nut assembly part 20 while turning the nut assembly part 20 and thereby the cable-engaging assembly 134. The coaxial cable 12 and connecting assembly 10 are fully assembled, as shown at block 220, with the connecting body 48 electrically connected to the metallic sheath 32 and the insulating jacket 34 fully seated and captive between the connecting body 48 and the sleeve assembly 120. Thereafter, the nut assembly 18 is placed in the first state, shown at block 222, after which the nut assembly part 20 is tightened against the male connecting port 14, as shown at block 224.

The extended length and diameter of the nut assemblies 20, 20', 20", 20'" make it possible to achieve torques, through hand manipulation, at least double that achievable with a standard 7⁄16 inch nut. While this torque is well below recommended assembly torques, i.e. in the 30 inch-pound range, the torque may be adequate to overcome thread roughness, drag created by accessory seals, etc., and to fully seat contact surfaces on the connecting assembly 10 and the male connecting port 14. As noted above, the larger graspable surface area on the nut assemblies 20, 20', 20", 20'" allows the installer to grasp and exert a substantial axial assembly force between the connecting assembly 10 and cable, while simultaneously turning the cable-engaging assembly 134 with a relatively large force. As a result, defective/inadequate connections can be reduced, or altogether avoided, providing peace of mind to both the installer and the customer.

The foregoing disclosure of specific embodiments is intended to be illustrative of the broad concepts comprehended by the invention.

What is claimed is:

1. An assembly for connecting a coaxial cable with a conductive sheath and a surrounding insulating jacket to a threaded male connecting port, the connecting assembly comprising:

a tubular fitting having a central axis and axially spaced first and second ends, the tubular fitting comprising a rotatable nut assembly at the first end to threadably engage a threaded male connecting port, the tubular fitting further comprising a cylindrical connecting body for engaging a conductive sheath on a coaxial cable, the tubular fitting further comprising a sleeve assembly around the connecting body, the sleeve assembly and connecting body cooperatively defining a cable-engaging assembly and configured so that an insulating jacket on a coaxial cable operatively connected to the connecting assembly is captively located between the sleeve assembly and connecting body, the rotatable nut assembly having a first shoulder and the cable-engaging assembly having a second shoulder, the first and second shoulders selectively engageable to allow at least a part of the rotatable nut assembly to be pivoted around the central axis to bear the first shoulder against the second shoulder and thereby urge at least a part of the cable-engaging assembly in movement around the central axis.

2. The assembly for connecting a coaxial cable to a threaded male connecting port according to claim 1 wherein the first and second shoulders face in circumferentially opposite directions relative to the central axis.

3. The assembly for connecting a coaxial cable to a threaded male connecting port according to claim 1 wherein the sleeve assembly is joined to the connecting body to define the cable-engaging assembly and the second shoulder is on the sleeve assembly.

4. The assembly for connecting a coaxial cable to a threaded male connecting port according to claim 3 wherein one of the sleeve assembly and connecting body has a projection defining one of the first and second shoulders and the other of the sleeve assembly and connecting body has a receptacle for the projection and defines the other of the first and second shoulders.

5. The assembly for connecting a coaxial cable to a threaded male connecting port according to claim 1 wherein the nut assembly has a rotatable part with threads to engage threads on a threaded male connecting port and first and second states, with the nut assembly in the first state the rotatable part can be pivoted through 360° around the central axis without causing the first and second shoulders to engage, and with the nut assembly in the second state pivoting of the rotatable part causes the first shoulder to engage the second shoulder.

6. The assembly for connecting a coaxial cable to a threaded male connecting port according to claim 5 wherein the nut assembly is changeable from the first state into the second state by moving the rotatable part of the nut assembly axially relative to the cable-engaging assembly.

7. The assembly for connecting a coaxial cable to a threaded male connecting port according to claim 6 wherein the entire nut assembly is movable as one piece around the central axis of the tubular fitting.

8. The assembly for connecting a coaxial cable to a threaded male connecting port according to claim 1 wherein there is a third shoulder on the nut assembly and a fourth shoulder on the cable-engaging assembly, the third shoulder engaging the fourth shoulders simultaneously as the first shoulder engages the second shoulder, the third and fourth shoulders selectively engageable to allow the at least part of the rotatable nut assembly to be pivoted around the central axis to bear the third shoulder against the fourth shoulder and thereby urge the at least part of the cable-engaging assembly in movement around the central axis.

9. The assembly for connecting a coaxial cable to a threaded male connecting port according to claim 6 wherein the rotatable part of the nut assembly is slidable guidingly along the cable-engaging assembly.

10. The assembly for connecting a coaxial cable to a threaded male connecting port according to claim 9 wherein the rotatable part of the nut assembly is slidable guidingly along the cylindrical connecting body.

11. The assembly for connecting a coaxial cable to a threaded male connecting port according to claim 10 wherein the cylindrical connecting body has a first stop surface facing axially in a first direction, the sleeve assembly defines a second stop surface facing axially oppositely to the first direction, the rotatable part of the nut assembly has a portion that resides between the first and second stop surfaces, the portion of the rotatable part of the nut assembly movable a predetermined axial distance between a) a first position wherein the portion of the rotatable part of the nut assembly abuts to the first stop surface and b) a second position wherein the portion of the rotatable part of the nut assembly abuts to the second stop surface, the nut assembly in the first state with the portion of the rotatable part of the nut assembly in the first position and in the second state with the portion of the rotatable part of the nut assembly in the second position.

12. The assembly for connecting a coaxial cable to a threaded male connecting port according to claim 1 wherein the tubular fitting has a length between the first and second ends, the nut assembly has a rotatable part with threads to engage threads on a threaded male connecting port, the rotatable part of the nut assembly having a radially outwardly facing surface that is engageable by a user to facilitate pivoting movement of the rotatable part around the central axis, and the radially outwardly facing surface has a length that extends to at least one half the length of the tubular fitting.

13. The assembly for connecting a coaxial cable to a threaded male connecting port according to claim 12 wherein the radially outwardly facing surface extends to at least three fourths of the length of the tubular fitting.

14. The assembly for connecting a coaxial cable to a threaded male connecting port according to claim 12 wherein the radially outwardly facing surface has a diameter and a portion of the radially outwardly facing surface increases progressively in diameter along the central axis.

15. The assembly for connecting a coaxial cable to a threaded male connecting port according to claim 12 wherein the radially outwardly facing surface has a contoured shape to facilitate grasping between two fingers of a user.

16. The assembly for connecting a coaxial cable to a threaded male connecting port according to claim 12 wherein the radially outwardly facing surface has a substantially cylindrical shape with circumferentially spaced grooves formed therethrough.

17. The assembly for connecting a coaxial cable to a threaded male connecting port according to claim 12 wherein the radially outwardly facing surface has a polygonally-shaped portion which is engageable with a turning tool, the polygonally-shaped portion extends over less than one half the length of the radially outwardly facing surface.

18. The assembly for connecting a coaxial cable to a threaded male connecting port according to claim 12 wherein the threads on the rotatable part are dimensioned to accommodate a male connecting port having a first diameter and the radially outwardly facing surface extends to a second diameter that is at least 1.2 times the first diameter.

19. The assembly for connecting a coaxial cable to a threaded male connecting port according to claim 18 wherein the second diameter is at least 1.4 times the first diameter.

20. The assembly for connecting a coaxial cable to a threaded male connecting port according to claim 18 wherein the second diameter is at least 1.5 times the first diameter.

21. An assembly for connecting a coaxial cable with a conductive sheath and a surrounding insulating jacket to a threaded male connecting port, the connecting assembly comprising:

a tubular fitting having a central axis and axially spaced first and second ends, nut means at the first end of the tubular fitting and having a rotatable part to threadably engage a threaded male connecting port, the nut means having a first state and a second state, first means on the tubular fitting to receive a coaxial cable at the second end of the tubular fitting and to electrically and mechanically connect to a coaxial cable directed into the second end of the tubular fitting, the nut means and first means cooperating to a) allow the nut means to pivot through 360° around the central axis without thereby causing any part of the first means to pivot around the central axis with the nut means in the first state and b) cause a part of the first means to follow pivoting movement of the rotatable part of the nut means around the central axis with the nut means in the second state.

22. A method of connecting a coaxial cable with a conductive sheath, a surrounding insulating jacket, and a core element to a threaded male connecting port, the method comprising the steps of:

providing a connecting assembly comprising a tubular fitting having a central axis and axially spaced first and second ends, the tubular fitting comprising a rotatable nut assembly with a rotatable part at the first end of the tubular fitting, a cylindrical connecting body, and a sleeve assembly, with the sleeve assembly and connecting body cooperatively define a cable-engaging assembly;

directing the coaxial cable into the second end of the tubular fitting so that the tubular fitting and coaxial cable are in a first relative axial relationship wherein a part of the tubular fitting resides between the insulating jacket and the core of the coaxial cable; and with the coaxial cable and tubular fitting in the first relative axial relationship, moving the coaxial cable and tubular fitting towards each other while turning the part of the tubular fitting around the central axis of the tubular fitting;

placing the coaxial cable and tubular fitting in an operative relative axial relationship;

electrically connecting the connecting body to the conductive sheath; and threadably engaging the rotatable part of the rotatable nut assembly with the threaded male connecting port.

23. The method of connecting a coaxial cable to a threaded male connecting port according to claim 22 wherein the step of turning the part of the tubular fitting comprises turning the rotatable part of the nut assembly and thereby causing the rotatable part of the nut assembly to turn the part of the tubular fitting.

24. The method of connecting a coaxial cable to a threaded male connecting port according to claim 23 wherein the step of turning the part of the tubular fitting comprises turning the connecting body.

25. The method of connecting a coaxial cable to a threaded male connecting port according to claim 23 wherein the step of threadably engaging the rotatable part of the rotatable nut assembly comprises turning the rotatable part of the nut assembly with the nut assembly in a first state and further comprising the step of placing the nut assembly in a second state before turning the part of the tubular fitting.

26. The method of connecting a coaxial cable to a threaded male connecting port according to claim 22 wherein the rotatable part of the nut assembly has a radially outwardly facing surface and the step of turning the part of the tubular fitting comprises gripping the radially outwardly facing surface between a user's fingers and turning the part of the tubular fitting through the radially outwardly facing surface.

27. The method of connecting a coaxial cable to a threaded male connecting port according to claim 22 wherein the rotatable part of the nut assembly has a polygonally-shaped outer surface and the step of turning the part of the tubular fitting comprises engaging the polygonally-shaped surface with a tool and manipulating the tool.

* * * * *